United States Patent [19]

Tomuro

[11] 4,157,851

[45] Jun. 12, 1979

[54] ASCENT AND DESCENT MEANS OF A FREE-ARM SEWING MACHINE

[76] Inventor: Yasushi Tomuro, No. 11-3, Tamagawa Denenchofu 2-chome, Setagaya-ku, Tokyo, Japan

[21] Appl. No.: 807,750

[22] Filed: Jun. 17, 1977

[51] Int. Cl.[2] ..... A47B 51/00

[52] U.S. Cl. ..... 312/29; 312/30; 312/306; 312/312; 108/147

[58] Field of Search ..... 312/21-30, 312/312, 306, 208; 108/136, 147

[56] References Cited

U.S. PATENT DOCUMENTS

| | | | |
|---|---|---|---|
| Re. 28,835 | 6/1976 | Roberts et al. | 312/29 |
| 1,778,510 | 10/1930 | Richardson | 312/29 |
| 2,738,248 | 3/1956 | Berker | 312/29 |
| 2,790,689 | 4/1957 | Hubbell | 312/21 |
| 2,885,253 | 5/1959 | Kesling | 312/306 |
| 2,931,685 | 4/1960 | Butler | 312/312 |
| 3,438,687 | 4/1969 | Wikey | 312/21 |
| 3,774,872 | 11/1973 | Morelli | 312/312 |
| 3,941,440 | 3/1976 | Menzin et al. | 312/136 |
| 4,005,918 | 2/1977 | Smith et al. | 312/30 |

FOREIGN PATENT DOCUMENTS

| | | | |
|---|---|---|---|
| 509347 | 3/1952 | Belgium | 312/29 |
| 820623 | 9/1951 | Fed. Rep. of Germany | 312/312 |

*Primary Examiner*—Victor N. Sakran
*Attorney, Agent, or Firm*—Michael J. Striker

[57] ABSTRACT

The present invention relates to a device for moving upwardly and downwardly a heavy device like a sewing machine body by make use of a constantly loading spring, more particularly, an ascent and descent means of a free-arm sewing machine, comprising an ascent and descent guide means like a guide rail in a cabinet of a free-arm sewing machine, a guide bar slidable inside the ascent and descent guide means, said guide bar being installed under a rectangular base plate for fixing the sewing machine body, a constantly loading spring of balanced or over-balanced load to be provided between the cabinet and the base plate, and a latch means which is provided at the ascent and descent guide means in order to fix the sewing machine body at a preferred position.

2 Claims, 11 Drawing Figures

ASCENT AND DESCENT MEANS OF A FREE-ARM SEWING MACHINE

BACKGROUND OF THE INVENTION

According to a conventional art of sewing machine, a considerably strong operational power and a complicated mechanism are required for moving upwardly or downwardly a heavy sewing machine body and fixing it at a desired height.

For example, a normal sewing machine 2 has an arm 1 for sewing a cylindrical-shaped sleeve or cuff or armhole or the like of clothes. As shown in FIGS. 1 and 2, a recess 4 is formed on the surface of a cabinet 3. In case of a normal sewing an additional plate 5 is covered on the recess 4 so as to maintain the height equal to the surface of the cabinet 3. In case of sewing a cylindrical-shaped object of clothes, the additional plate 5 is to be dismounted and then a cylindrical-shaped object of clothes is inserted into the arm 1. Further, when storing the sewing machine body 6 in the cabinet 3, as shown in FIG. 3 it is stored to a downward direction of the cabinet 3 by way of a hinge 7 disposed at the corner end of the recess 4.

In this case, it is required to produce specifically the cabinet 3 for this purpose. Further, the disadvantage of a known sewing machine has the tendency that waste threads are thick in the recess 4, and that it is not easy to sew a cylindrical-shaped object of clothes inserted in the arm 1 placed within the recess 4. Still further, when incorporating the sewing machine body 6 in the cabinet 3 or taking it therefrom, because of the heavy weight of the sewing machine body 6 itself the operation becomes worse and risky. The instant invention has been attained in order to overcome the above inconveniences of a conventional sewing machine.

SUMMARY OF THE INVENTION

It is the primary object of this invention to provide an ascent and descent means of a free-arm sewing machine, comprising an ascent and descent guide means like a guide rail in a cabinet of a free-arm sewing machine, a guide bar slidable inside the ascent and descent guide, said guide bar being installed under a rectangular base plate fixed with the sewing machine body, a constantly loading spring of balanced or overbalanced load to be provided between the cabinet and the base plate, and a latch means which is provided at the ascent and descent guide means in order to fix the sewing machine body at a preferred position.

According to a remarkable aspect of this invention, by making use of the constantly loading spring, a heavy-free-arm sewing machine body can be constantly maintained under the balanced state. And due to the a very smooth operation of the ascent and descent means the free-arm sewing machine body can be accurately moved to a preferred position.

It is another object of this invention to provide an ascent and descent means of a free-arm sewing machine, which can be manufactured at a lower cost and constructed strongly.

Other features and advantages of the invention will be apparent from the following description taken in connection with the accompanying drawings.

DETAILED DESCRIPTION OF THE INVENTION

Figure 1:
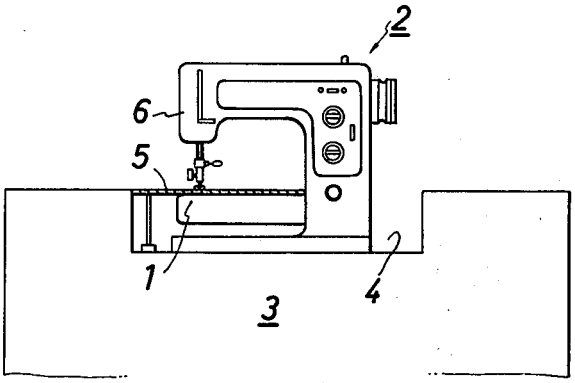
FIG. 1 is a view showing the condition of normal sewing by a known free-arm sewing machine.
Figure 2:
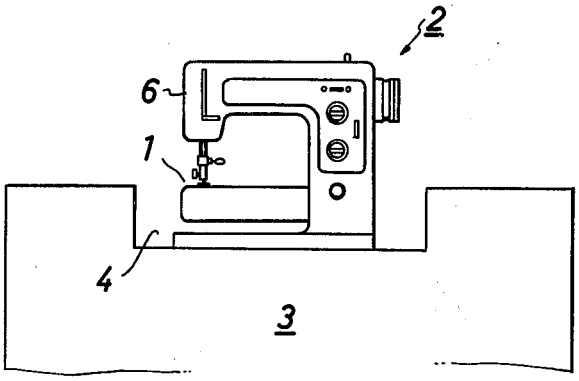
FIG. 2 is a view showing the condition of sewing of a cylindrical part of clothes by use of the known free-arm sewing machine in FIG. 1.
Figure 3:
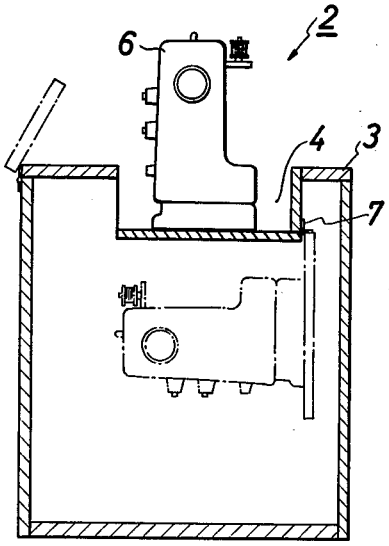
FIG. 3 is a view showing the condition of storing a sewing machine body in FIG. 1.

With reference to the accompanying drawings FIGS. 4 to 9, an embodiment of the present invention will now be described.

Numeral 11 is a rectangular base plate on which a free-arm sewing machine body 12 is firmly mounted and from which corner rear side is hung a guide rail 15 of U-shape in section where a guide channel is formed. And the guide channel 14 has a hole 13 for fixing the position of the sewing machine body 12, said hole 13 being spaced with a given distance. Further, a hook 17 of L-shape in section is fixed with the corner on a diagonal line of the sewing machine body 12.

Numeral 18 is a cabinet table in which is formed a rectangular opening 19 through which the rectangular base plate 11 can be freely passed. And the cabinet table 18 is placed on the upper side of the portion 21 for storing the free-arm sewing machine body 12. Further, a frame 23 having a rectangular opening 22 of the nearly same area to the rectangular opening 19 is fixed with the cabinet table 18, and is connected with a guide bar 25 including a stopper 24 therebelow. And at the position facing to the L-shape hook there is provided the constantly loading spring 16 having a certain extension which can take a balance or a little overbalance toward the weight of the sewing machine body 12 and the base plate 11. And the end of the constantly loading spring 16 is fixed with the hook 17. Since the guide bar 25 is fitted with the guide rail 15, the base plate 11 can ascend and descend along the guide rail 15.

Figure 5A:
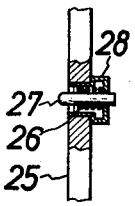
FIGS. 5(A), (B) and (C) are respective views of the main parts of the embodiment in FIG. 4.
Figure 5C:
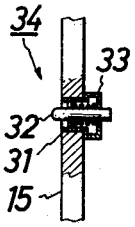
Figure 5B:
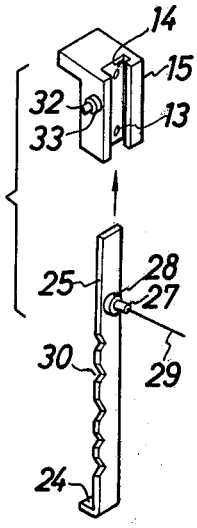

As shown in FIG. 5, the guide bar 25 is provided with a cylindrical case 28 in which a pin having a pressing force is incorporated. A wire 29 fixed with the rear part of the pin 27 is linked with a knob (not shown in the drawings). When fixing the position of the sewing machine body 12, by actuating the knob the pin 27 is to be projected from the case 28 due to resilience of the coil spring 26 so that it can be inserted and locked in the hole 13 of the guide rail 15.

Further, along the edge of the guide bar 25 there are provided with V-shape latch means 30, while at the side of the guide rail 15 there is provided a case 33 in which is incorporated a pin 32 having a coil spring 31 of a preferred load. And a resilient force of the coil spring 31 is applied to the pin 32. Still further, there is provided a latch means 34 so that the pin 32 can be projected from the hole bored in the case 33 into the guide channel 14, the pin 32 being removably engaged with each latch groove 30. Refer to FIG. 5(C).

The operational function of the above mechanism will now be described.

Figure 7:
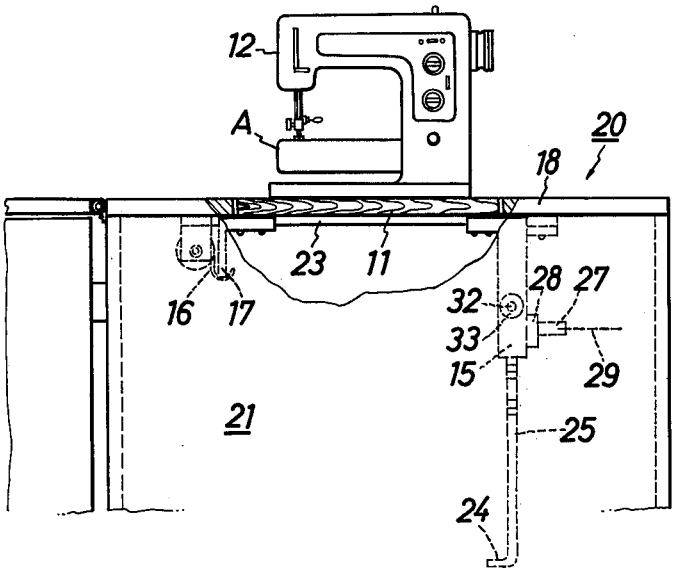
FIG. 7 is a front view showing the condition of sewing of a cylindrical part of clothes by use of the free-arm sewing machine according to the present invention.
Figure 8:
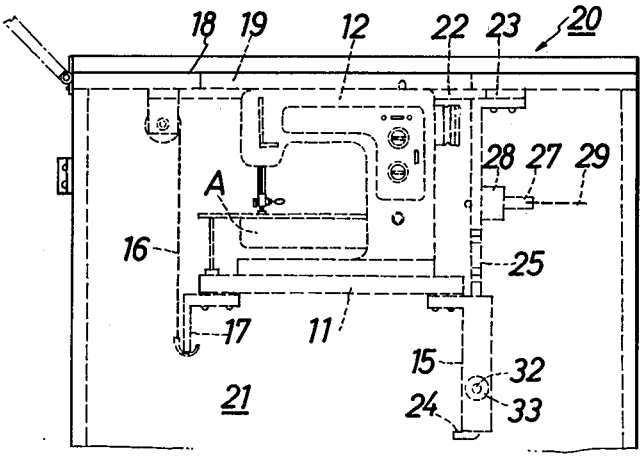
FIG. 8 is a front view showing the condition of storing a sewing machine body in FIG. 7.

In use the sewing machine body 12 is movable appropriately toward the surface of the cabinet table 18. Since the load of the constantly loading spring 16 is balanced or a little overbalanced with the weight of the sewing machine body 12 and the rectangular base plate, it is movable with a very smooth operation. In addition, while the sewing machine body 12 is being moved upwardly or downwardly under the pressure, the pin 30 can be engaged continously with the latch grooves 30. And when the sewing machine body 12 is stopped, the pin 32 is inserted and locked in the latch groove 30. When lifting the sewing machine body 12 to a preferred position, the pin 27 is automatically inserted in the hole 13 of the guide rail 15, and the rectangular base plate 11 and the guide rail 15 can be firmly fixed with the guide bar 25. After that, when installing the additional plate 5 for covering a space between the cabinet table 18 and the sewing machine body 12, a normal sewing can be attained. Concerning the above function, refer to FIG. 6. On the other hand, when sewing cylindrical objects of clothes, a knob shall be operated. After the pin 27 is removed from the hole 13, the base plate 11 fixed with the sewing machine body 12 is raised to the approximately same height to the cabinet table 18, the pin 27 is automatically inserted in the hole 13, the base plate 11 is fixed with the guide bar 25. Thus, an arm A of the free-arm sewing machine body 12 (shown in FIG. 7) is positioned above the cabinet table 18. Accordingly, a cylindrical object of clothes is not placed within the cabinet 20. In other words, when using the ascent and descent means according to this invention, just like a known sewing machine it is very easy to sew a cylindrical object of clothes. Refer to FIG. 7. This is one of the most remarkable features of this invention. Further, when storing the free-arm sewing machine body 12 into the cabinet 20, it is required to remove the pin 27 from the hole 13. Then, when moving the sewing machine body 12 downwardly of the cabinet 20, the guide rail 15 is contacted with the stopper 24 formed by the guide bar 25. Thus, the free-arm sewing machine body 12 can be stored stably. Refer to FIG. 8.

Figure 4:
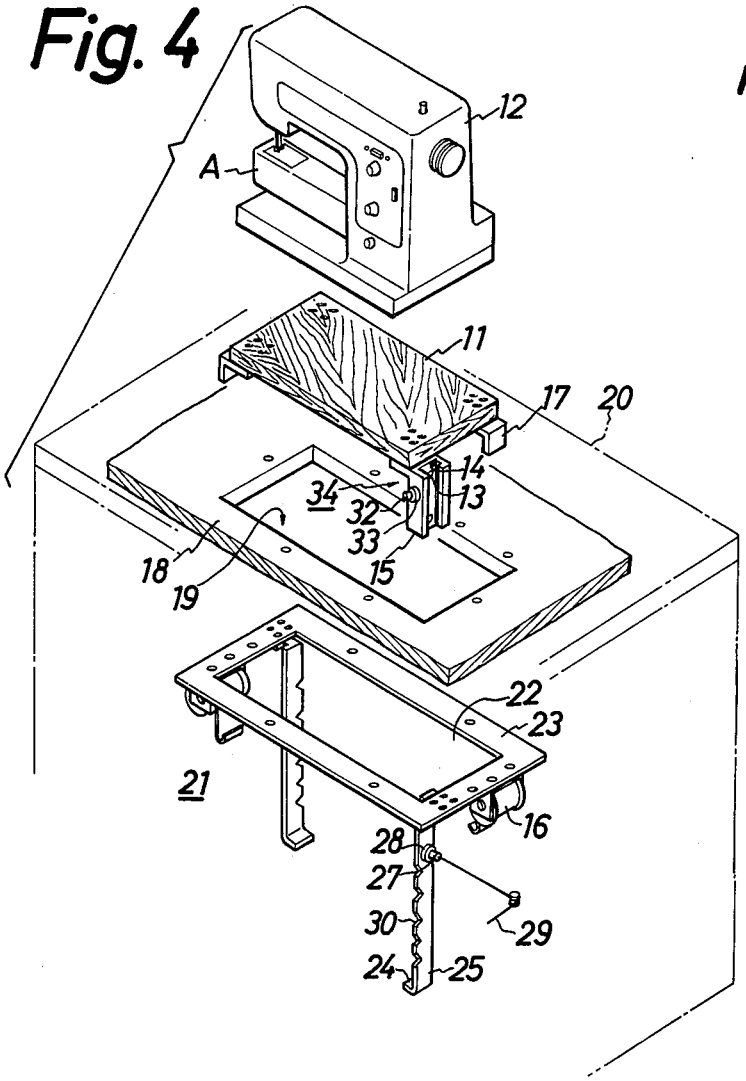
FIG. 4 is an exploded perspective view of an embodiment of an ascent and descent means of a free-arm sewing machine according to the present invention.

As described above, in case the constantly loading spring 16 is designed to be overbalanced a little bit, the free-arm sewing machine body 12 is ascending automatically to the position of either a normal sewing or sewing of cylindrical objects of clothes. Although this is a convenient factor, when storing the sewing machine body 12 into the depth of the cabinet it is not so easy to contact the guide rail 15 to the stopper 24. Therefore, the latch means 34 is provided as shown in FIG. 4 so that the sewing machine body can descend downwardly step by step. Further, owing to the latch means 34 the sewing machine body 12 can ascend upwardly step by step and stably.

Figure 9:
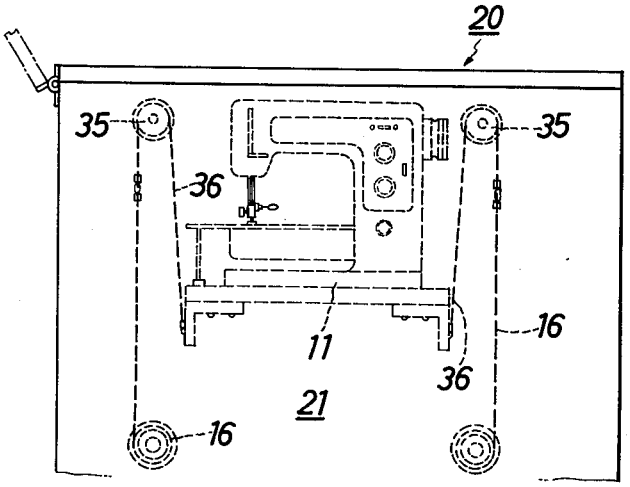
FIG. 9 is a view of another embodiment of an ascent and descent means of a free-arm sewing machine according to the present invention.
Figure 6:
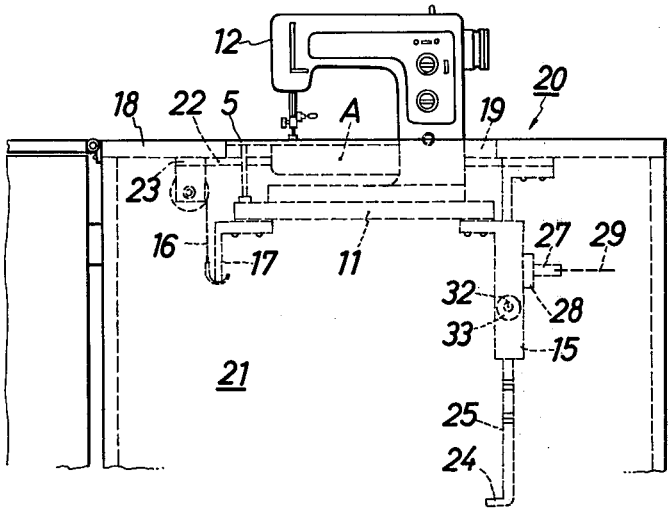
FIG. 6 is a front view showing the condition of normal sewing in the embodiment in FIG. 4.

Another embodiment will now be described in reference with FIG. 9. As shown in FIG. 9, the constantly loading spring 16 is installed at the lower part of the cabinet 20. And an end of a wire 36 is fixed with the base plate 11 by way of a plurality of pulleys 35, while another end thereof is fixed with the constantly loading spring 16. Under this structure the same operational effect to the aforementioned embodiment can be attained.

Needless to say, the present invention is not limited to the foregoing specific embodiments. For instance, it is also desired to mount the guide bar 25 to the base plate 11 or to mount the guide rail 15 to the frame 23. Alternatively, by dismantling the frame 23, it will be available to mount the guide bar 25 and the constantly loading spring 16 directly to the cabinet table 18. Further, the guide rail 15, the guide bar 25, the latch means 34 and other components may be modified without departing from the spirit and scope of this invention.

As described previously, by making use of a constantly loading spring, the weight of a heavy object like a sewing machine body can be constantly maintained under the balanced state. And due to a very smooth operation of an ascent and descent means, the sewing machine body can be accurately moved to a preferred position. Further, an ascent and descent means of a free-arm sewing machine body according to this invention can be manufactured at a lower cost and constructed strongly.

What is claimed is:

1. In a vertically adjustable mount for a free arm sewing machine in a cabinet, a combination comprising guiding means including a first vertical guide member secured to said sewing machine, a second vertical guide member secured to said cabinet and slidably fitting in with said first guide member; first latch means including two vertically spaced holes in said first guide member and a spring biased pin arranged on said second guide member to engage one of said holes for arresting said machine in a selected working position; hand-operated unlatching means connected to said pin to release said pin from said hole; a stop member provided on said second guide member to hold said first guide member and thus the sewing machine in a storing position within said cabinet; and constant-force spring means arranged between said cabinet and said sewing machine to balance the weight of the latter and of said guiding means wherein said spring means is adjusted to over-balance the said sewing machine; and further comprising second latch means having a spring-biased second pin arranged on one of said guide members and a plurability of notches provided on the other guide member to slidably engage with said second pin.

2. A combination as defined in claim 1, wherein said spring means is installed at the lower part of the cabinet; and further including a plurality of pulleys and a wire for coupling said spring means to said sewing machine.

* * * * *